United States Patent [19]

Gilbert

[11] 4,331,234

[45] May 25, 1982

[54] SHIPPING CONTAINER FOR APPLIANCES

[75] Inventor: Earl F. Gilbert, Farmington Hills, Mich.

[73] Assignee: Westvaco Corporation, New York, N.Y.

[21] Appl. No.: 121,160

[22] Filed: Feb. 13, 1980

[51] Int. Cl.[3] ..... B65D 85/46; B65D 19/00

[52] U.S. Cl. ..... 206/320; 206/591; 206/599; 206/600

[58] Field of Search ..... 206/521, 587, 585, 591, 206/386, 597, 599, 600, 320

[56] References Cited

U.S. PATENT DOCUMENTS

| | | | |
|---|---|---|---|
| 2,902,199 | 9/1959 | Breton | 206/599 |
| 3,215,331 | 11/1965 | Techman | 206/521 |
| 4,050,604 | 9/1977 | Flanders | 206/599 |

FOREIGN PATENT DOCUMENTS

| | | | |
|---|---|---|---|
| 2128214 | 12/1971 | Fed. Rep. of Germany | 206/599 |
| 2756960 | 5/1979 | Fed. Rep. of Germany | 206/599 |
| 2314868 | 1/1977 | France | 206/599 |
| 1519741 | 8/1978 | United Kingdom | 206/599 |
| 2007194A | 5/1979 | United Kingdom | 206/599 |

*Primary Examiner*—Joseph Man-Fu Moy

[57] ABSTRACT

A shipping container for appliances or the like comprises in combination an outer container element and a base pad element. The outer container element includes scored bottom closure flaps which are folded to provide integral skid type runners at the bottom thereof and the base pad element is formed from a cut and scored blank that is folded to produce a triple thick construction which is secured to the appliance or the like.

2 Claims, 6 Drawing Figures

SHIPPING CONTAINER FOR APPLIANCES

BACKGROUND OF INVENTION

Shipping containers are required for almost all household appliances during shipment from the manufacturer to the retailer and for storage. Most of such shipping containers are combined with pallets that are generally constructed from wood. The pallets are necessary to elevate the appliances and permit them to be readily moved during delivery and for storage. In other instances the appliances are provided with pads or collars which protect the packaged products from damage during shipment. However, in almost all instances, both pallets and corner protectors are used when packaging appliances.

U.S. Pat. No. 2,196,157 illustrates, for example, a type of packing collar used for packaging a refrigerator. Meanwhile, U.S. Pat. Nos. 2,372,055 and 3,907,241 each show temporary skid elements that are used for packaging appliances.

For shipping products other than appliances, it is not unusual to find that the shipping containers are specifically designed for the intended products. For instance, French Pat. No. 656,487 granted Jan. 2, 1929, shows a shipping container with separate top and bottom base pads that are designed specifically for accomodating a plurality of bottles. Other patents that disclose base pads which are tailored specifically for the intended products include U.S. Pat. Nos. 2,818,974 and 3,258,116, which show shipping containers for tubes of yarn. However, the known prior art does not disclose in a single source a shipping container that includes a base pad element and an outer container with integral skid elements that cooperate to produce a structure which effectively eliminates the need for separate wooden pallets or other pallet structures during shipment.

SUMMARY OF INVENTION

The present invention relates to an improved shipping container for household appliances, and more particularly to the combination of an improved inner base pad for the appliance and an outer shipping container with integral skid runners. Accordingly, the shipping container of the present invention is intended for shipping those appliances that normally require a wooden pallet or skid to form a bottom that will accomodate the lifting forks of a forklift truck or the like.

It is commonplace to provide shipping containers with inside support means for household appliances or the like during manufacture, shipment and storage. For this purpose, interior packing members such as corner posts, packing collars and other such padding devices are well known. However, in almost every instance, the padding devices are generally not attached to the packaged product, and separate pallets are required for supporting the shipping container.

In the present invention the lower base pad is formed from a single blank of material to provide a triple thick construction which is bolted or otherwise attached to the packaged appliance. Meanwhile, the outer shipping container is provided with corner posts and with conventional upper and lower closure flaps, except that the lower closure flaps on at least two opposed sides of the outer container are scored and folded into overlapping layers to provide integral skid like runners on the bottom of the shipping container. Thus, when the appliance with its attached base pad is inserted in the outer shipping container, the base pad element serves as both the bottom of the container and as a pallet for the shipping container. This arrangement in combination with the integral skid type runners on the bottom of the shipping container provides sufficient elevation of the shipping container so that it can be readily handled by a fork lift truck or a hand cart.

The base pad element is preferably constructed from a single blank of double or triple wall corrugated paperboard. The blank is cut and scored to form several panels which are folded in overlapping relationship so that the direction of corrugations in one layer is perpendicular to that of another layer. In the preferred embodiment, the base pad comprises at least three layers of blank material. The blank is also provided with matching notches at each of its corners for accomodating corner posts that are arranged around the packaged product. Meanwhile, the different panels of the blank are provided with mating holes for receiving bolts or other attaching means for securing the base pad to the packaged appliance.

Accordingly, it is an object of the present invention to provide a combination shipping container and base pad for shipping any household appliance that would normally require a pallet or a skid type bottom.

Another object of the invention is to provide an improved base pad for a shipping container wherein the base pad is formed from a single blank of material that is cut and scored to produce a plurality of panels which are folded in overlapping relation and attached to the product to be shipped.

A further object of the present invention lies in the provision of integral skid type runners on the outer shipping container for the purpose of elevating the shipping container to permit handling of the container by fork lift truck, hand cart or the like.

DETAILED DESCRIPTION

Figure 1:
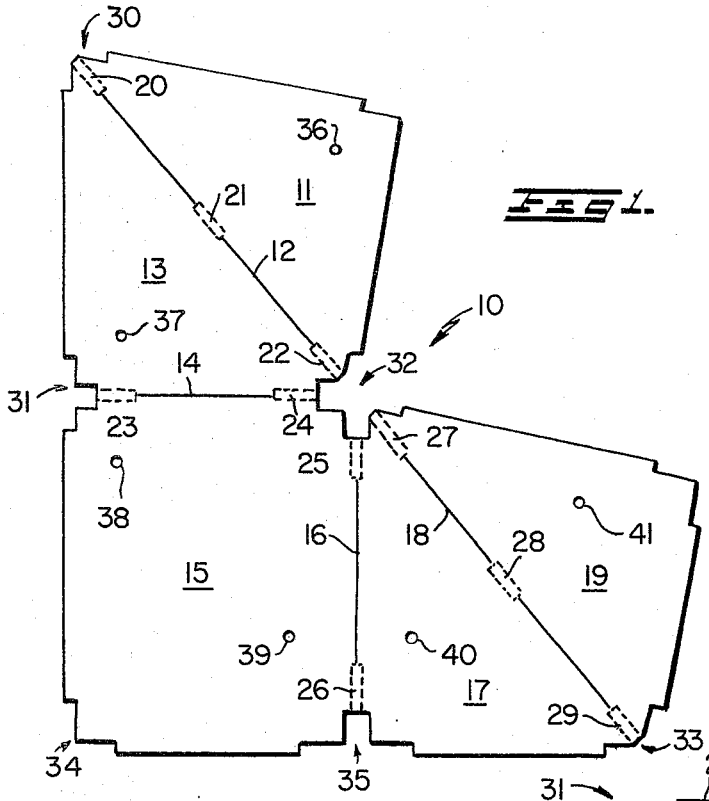
FIG. 1 is a plan view of a typical blank structure for forming the base pad element of the present invention.

In the exemplary embodiment of the invention disclosed in the drawing, a blank structure 10 is shown in FIG. 1 to consist of a plurality of panels 11, 13, 15, 17 and 19. Panels 11 and 13 are generally triangular in shape and are separated from one another by a cut score line 12. Panel 15 is generally rectangular in shape and is connected to panel 13 along a cut score line 14. Meanwhile, panels 17 and 19 are also generally triangular in shape, they are separated from one another along a cut score line 18 and panel 17 is connected to an adjacent edge of panel 15 along another cut score line 16. In each case, the cut score lines 12, 14, 16 and 18 are discontinuous so that the various panels remain attached to one another along hinge panels. For instance, panels 11 and 13 remain attached to one another by the hinge panels 20,21 and 22. Panel 15 is attached to panel 13 along hinge panels 23,24 and to panel 13 along hinge panels 25,26. Finally, panels 17 and 19 are attached to one another along hinge panels 27,28 and 29.

At each of the corners of the blank 10, notches are formed in the blank material as illustrated by the notches 30–35 which ultimately provide spaces at the corners of the base pad for accomodating corner posts. The blank is notched in such a manner that the corresponding cuts mate with one another when the respective panels are folded into overlapping relation. In addition each of the panels is applied with openings 36–41 which mate with one another when the blank is formed. The openings are provided in the panels to produce holes through which bolts or other attaching means are inserted to secure the packaged appliance to the base pad.

Figure 3:
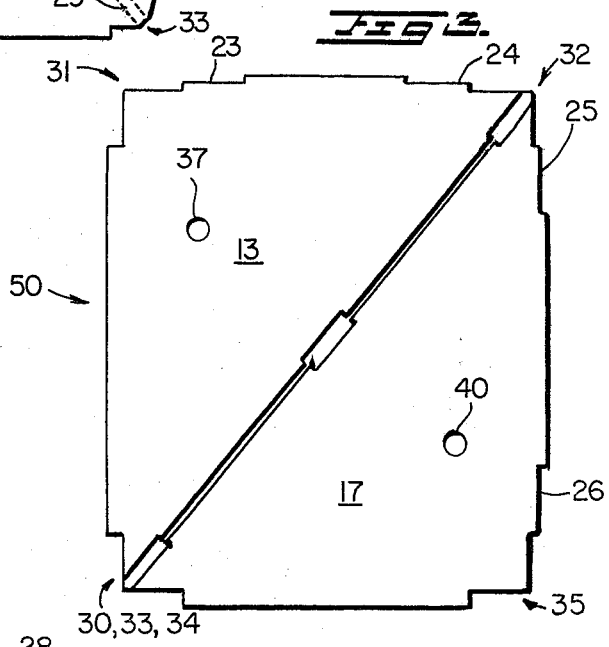
FIG. 3 is a top view of the completed base pad element.
Figure 2:
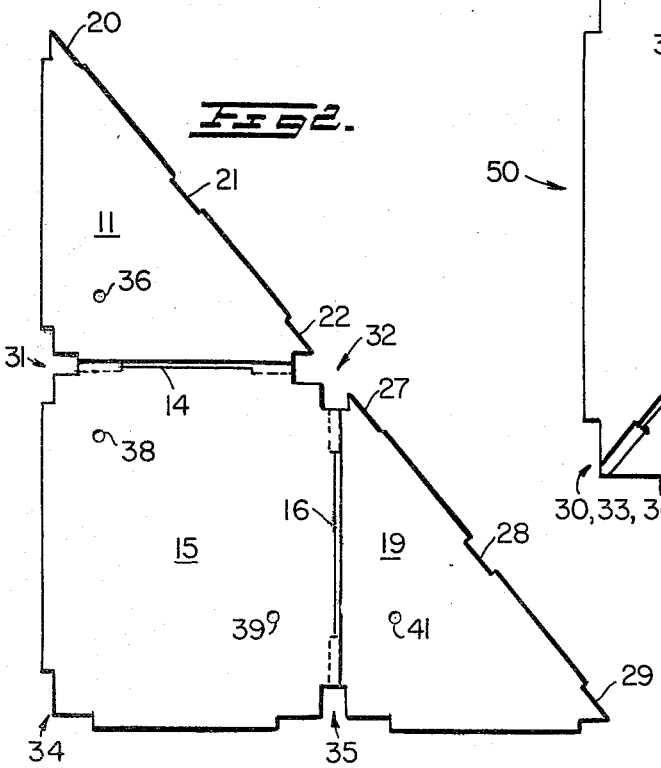
FIG. 2 is a plan view showing the first folding step for fabricating the base pad element.

FIG. 2 illustrates the first folding step in the fabrication of the base pad. For this purpose, panels 11 and 19 are folded about cut score lines 12 and 18 respectively to overlap panels 13 and 17. Subsequently, as shown in FIG. 3, the combined panels 11 and 13 are folded about cut score 14 to overlap a part of panel 15, and the combined panels 17 and 19 are folded about cut score 16 to overlap the remaining part of panel 15. These folding steps produce a base pad 50 that is three layers thick wherein the corrugations in each layer are perpendicular to the next subjacent layer. In addition, as shown from the top in FIG. 3, the openings 36,37,38 overlie and become aligned with one another while the openings 39,30,41 are similarly located with respect to one another. In like manner, the notched corners become aligned as shown.

After the base pad 50 is formed as shown in FIG. 3, it is attached to the bottom of an appliance or the like for shipping. Since the base pad is formed from multiple layers of corrugated paperboard, it provides improved cushioning and shock resistance for the product especially as compared with a wooden pallet. Moreover, because the corrugations in each layer are oriented perpendicular to one another, the base pad has increased strength as compared with other base pads of different construction.

Figure 4:
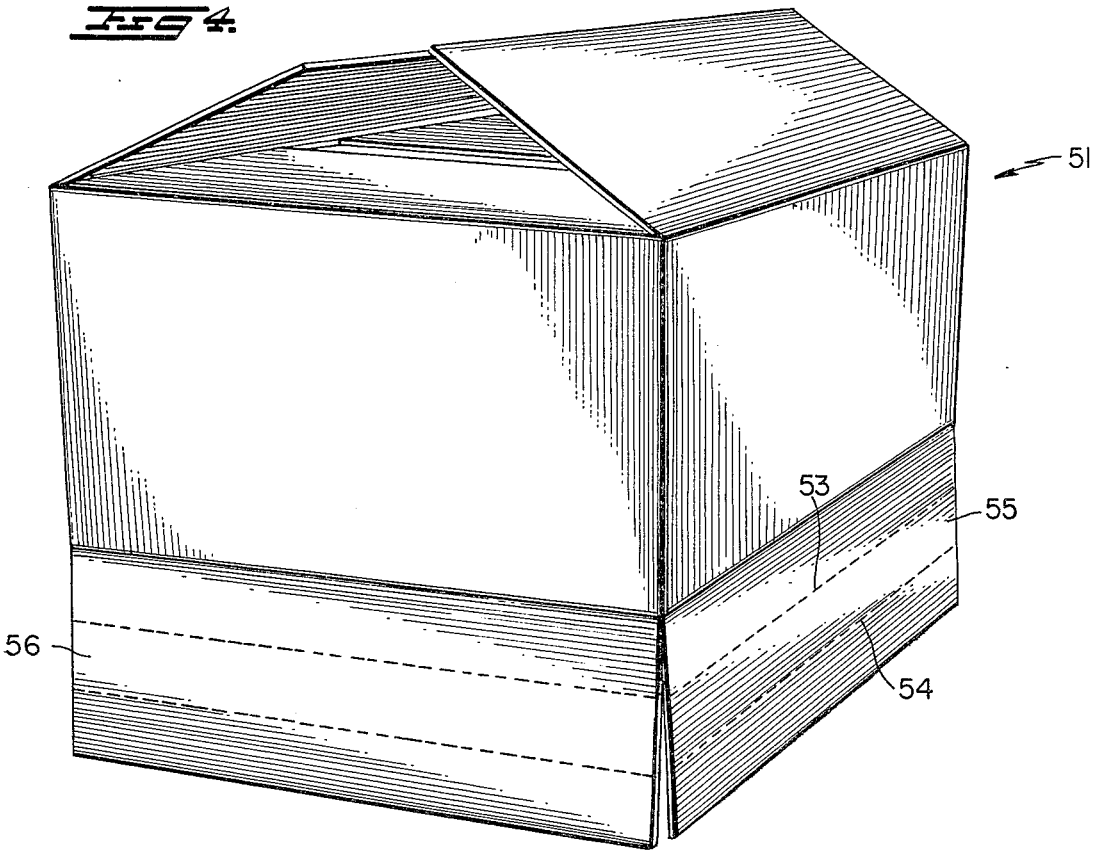
FIG. 4 is a perspective view of a typical outer shipping container for the present invention.
Figure 5:
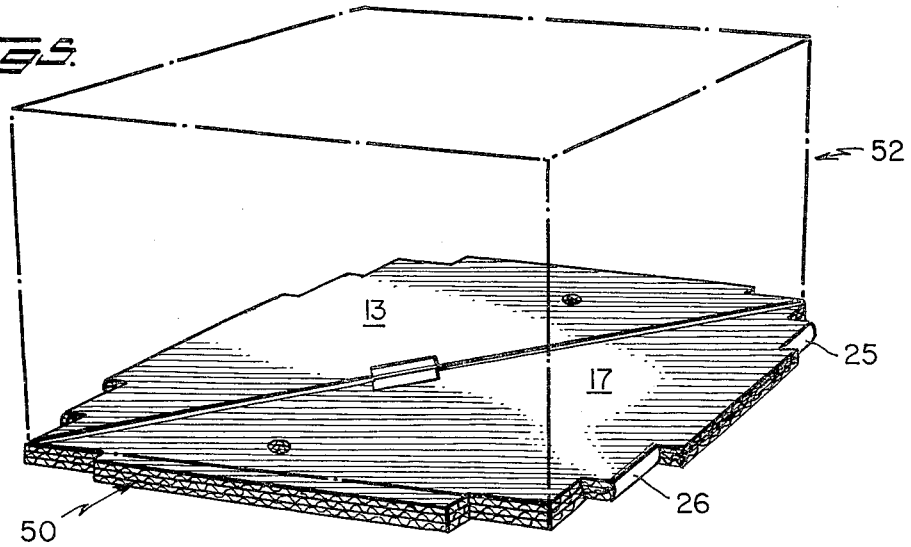
FIG. 5 is a perspective view showing the base pad element with an appliance shown in phantom lines secured thereto; and, FIG. 6 shows in perspective the outer shipping container with its skid type runners formed and with the combined base pad and appliance located therein.
Figure 6:
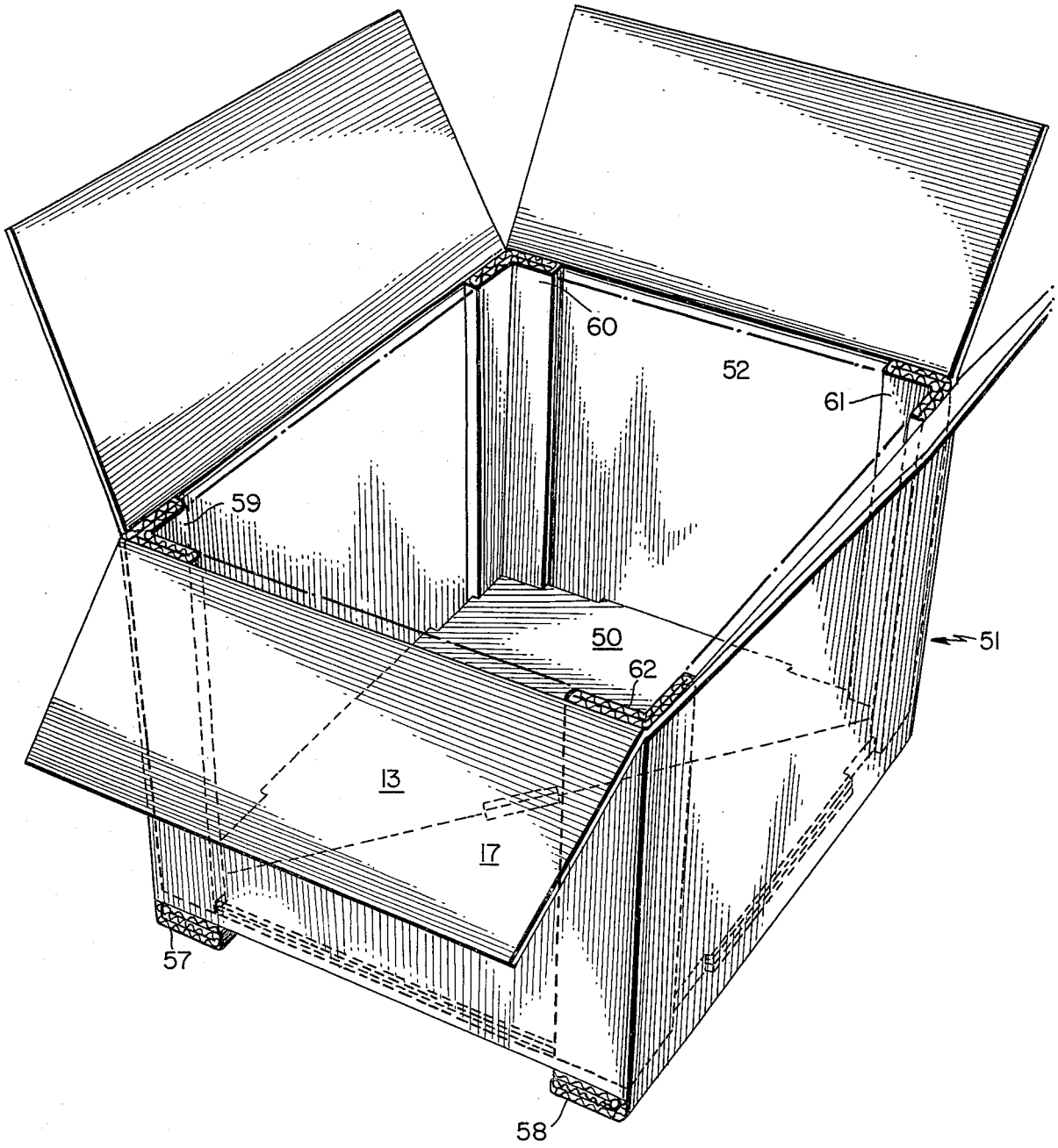

FIG. 4 illustrates a typical outer container construction 51 for the shipping container of the present invention. The outer container 51 is generally rectangular in shape and is sized so as to accomodate the combined base pad and appliance 52 shown in FIG. 5. The outer container 51 is characterized by the provision of score lines 53,54 in at least two opposed bottom closure flaps 56 of the container which are folded as shown in FIG. 6 to provide a pair of spaced skid type runners 57,58 on the bottom of the container.

The method whereby the shipping container is prepared is as follows. After the appliance or the like is bolted or otherwise attached to the base panel 50, the outer container 51 is lowered around the combination pad/appliance. The corner posts 59–62 are placed around the appliance and the bottom of the outer container is formed. For this purpose, a first pair of bottom closure flaps 55 on two opposed sides of the outer container are folded to lie adjacent to the base pad 50. Then the paired closure flaps 56 which contain the scores 53,54 are folded so that the panels formed by the scores 53,54 overlap one another to produce skid like runners on each side of the outer container. In this manner, the base pad 50 serves as a part of the bottom of the outer container 51 and as a pallet for the appliance. Meanwhile, the runners 57,58 elevate the base pad 50 for easy handling of the shipping container. Lastly, the top closure flaps of the outer container 51 are closed and sealed and the container is ready for shipment.

From the foregoing it may be seen that the present invention provides a strong and unique combination pallet and shipping container for shipping household appliances or the like. Thus, while only a single embodiment has been fully disclosed and illustrated, it will be understood that the invention is not to be limited except as defined by the appended claims.

I claim:

1. A shipping carton for appliances or the like comprising in combination an outer shipping container and an inner base pad for supporting said appliance, said outer shipping container being of generally rectangular configuration and having bottom closure flaps foldably attached thereto, a first pair of bottom closure flaps on two opposed sides of said outer container being folded to lie adjacent to said base pad, another pair of said bottom closure flaps on opposed sides thereof including a plurality of score lines which provide panels that are folded over in sequence to overlap one another and form skid like runners on each side of the outer container, said base pad being of generally rectangular configuration to fit within said outer container and formed from a single sheet of corrugated paperboard that is cut and scored to provide a plurality of panels and subpanels each including appliance attachment openings, said panels and subpanels being folded into a construction having three layers comprising, a first full sized panel of generally rectangular shape, a first pair of articulated subpanels foldably attached along one edge of said full sized panel and folded over upon themselves and a second pair of articulated subpanels foldably attached along an adjacent edge of said full sized panel and folded over upon themselves and then folded to lie adjacent to said full sized panel to provide a triple thick construction wherein said appliance attachment openings coincide, and means for attaching said appliance to said base pad through said appliance attachment openings.

2. The shipping carton of claim 1 wherein said base pad panels and subpanels each include notched corners which become aligned with one another when said panels and subpanels are folded adjacent one another to provide integral spaces for corner posts at each corner of the base pad.

* * * * *